United States Patent [19]

Lasley

[11] Patent Number: 4,934,607

[45] Date of Patent: Jun. 19, 1990

[54] HAND HELD ELECTROSTATIC SPRAY GUN WITH INTERNAL POWER SUPPLY

[75] Inventor: Charles T. Lasley, Toledo, Ohio

[73] Assignee: The DeVilbiss Company, Toledo, Ohio

[21] Appl. No.: 330,141

[22] Filed: Mar. 29, 1989

[51] Int. Cl.[5] ..... B05B 5/053

[52] U.S. Cl. ..... 239/691; 239/707; 239/132

[58] Field of Search ..... 239/128, 132, 132.1, 239/690, 691, 704, 707

[56] References Cited

U.S. PATENT DOCUMENTS 3,608,823 9/1971 Buschor ..... 239/15
3,731,145 5/1973 Senay ..... 317/3
4,462,061 7/1984 Mommsen ..... 361/227
4,752,034 6/1988 Kuhn et al. ..... 239/707

FOREIGN PATENT DOCUMENTS 0157199 10/1985 European Pat. Off. ..... 239/690

*Primary Examiner*—Andres Kashnikow
*Assistant Examiner*—Karen B. Merritt
*Attorney, Agent, or Firm*—MacMillan, Sobanski & Todd

[57] ABSTRACT

A hand held electrostatic spray gun having an electrostatic power supply mounted in the gun. The power supply includes a circuit module mounted in the gun handle which produces heat during operation. The circuit module has a heat conducting housing which is intimately attached to a heat conducting tube extending through the handle. Compressed air delivered through the tube to a nozzle for assisting atomization and/or pattern shaping cools the circuit module.

9 Claims, 2 Drawing Sheets

HAND HELD ELECTROSTATIC SPRAY GUN WITH INTERNAL POWER SUPPLY

TECHNICAL FIELD

This invention relates to hand held electrostatic paint spray guns and more particularly to an improved hand held electrostatic paint spray gun of the type having an internal high voltage power supply.

BACKGROUND ART

In applications where materials such as paint are applied by hand using an electrostatic spray gun, spray guns having internal power supplies are becoming increasingly popular. One reason for their popularity is that the guns are safer and easier to use than prior art electrostatic hand guns which require a heavy insulated high voltage wire. In a typical hand held electrostatic spray gun with an internal power supply, the power supply consists of two modules. In a first module, a low voltage direct current is converted to an alternating current by an oscillator. A voltage step-up transformer may be located in either the first or the second modules for increasing the voltage of the alternating current from the oscillator. The second module includes a voltage multiplier which rectifies and multiplies to a high voltage the output from the transformer. The voltage multiplier is typically a ladder or cascade network formed from capacitors and diodes.

Typical prior art hand held spray guns of this type are shown in U.S. Pat. No. 4,598,871 to Hartle, U.S. Pat. No. 4,750,676 to Huber et al. and U.S. Pat. No. 4,752,034 to Kuhn et al. In the spray guns in each of these patents, a circuit module for the high voltage power supply is located within the handle for the spray gun. During operation of the spray gun, the power supply will produce heat in addition to the high voltage. If the spray gun is used for an extended period of time, the handle may become sufficiently hot to be uncomfortable to the operator. The high temperature also may adversely affect the circuit components in the circuit module.

DISCLOSURE OF INVENTION

According to the present invention, a circuit module for a high voltage power supply is mounted in the handle of a hand held electrostatic spray gun. The circuit module, which generates heat during operation, has a heat conducting housing, for example, a housing made of aluminum. The housing is intimately attached to a tube in the handle through which atomization and/or pattern shaping air is delivered to the gun nozzle. The flow of air through the tube carries heat from the handle to maintain the handle at a comfortable temperature for the operator. Preferably, the handle has a thermally insulated cover which further reduces the exterior temperature of the handle.

Accordingly, it is an object of the invention to reduce the temperature of a handle on a hand held electrostatic spray gun wherein the handle contains a circuit module for a high voltage power supply.

Other objects and advantages of the invention will be apparent from the following detailed description and the accompanying drawings.

BEST MODE FOR CARRYING OUT THE INVENTION

Figure 1:
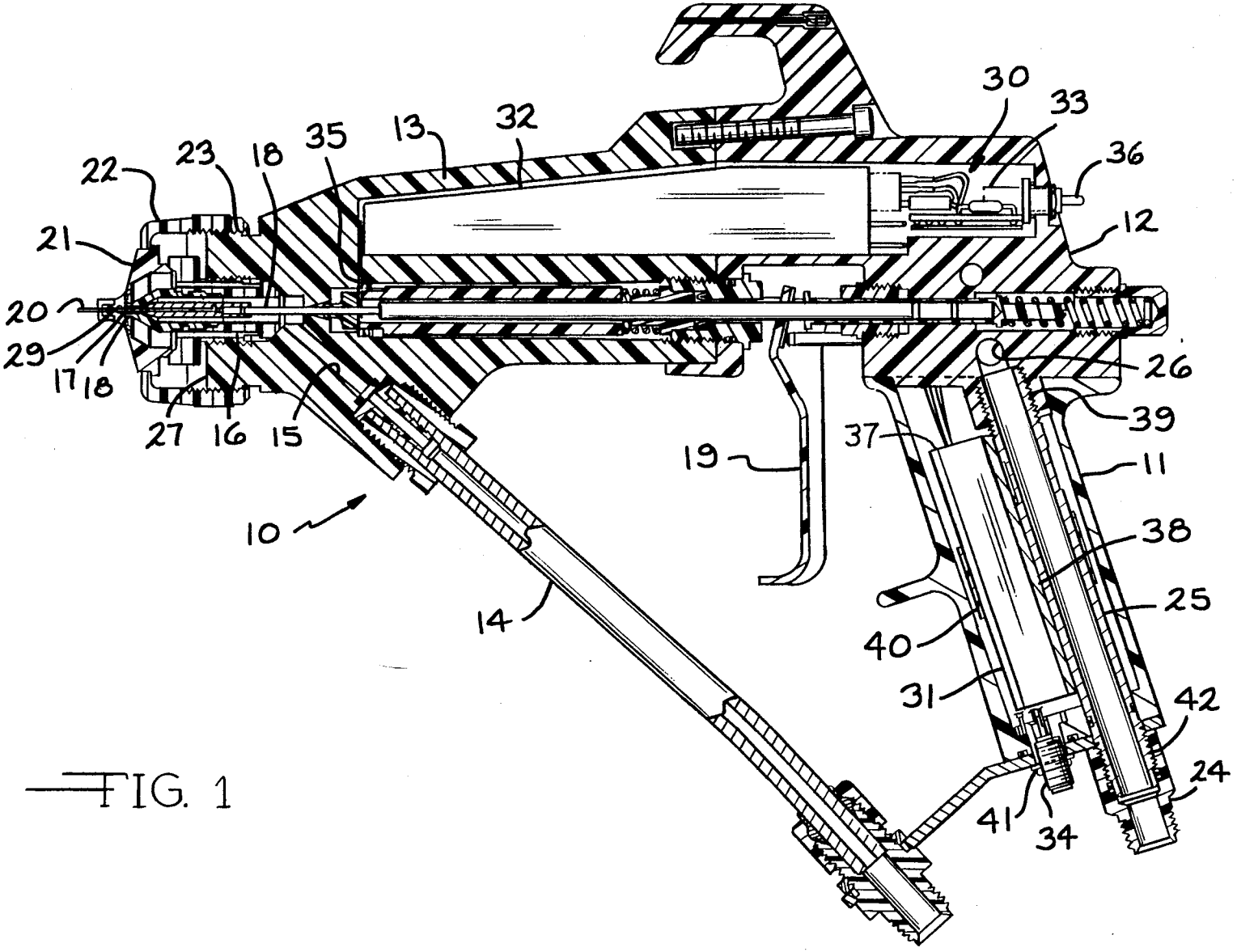
FIG. 1 is a cross sectional view through an electrostatic paint spray gun according to the invention.

Turning to the drawings and particularly to FIG. 1, a hand held electrostatic spray gun 10 is shown embodying the invention. The spray gun 10 is formed from three body sections comprising a handle 11, an intermediate body section 12 and a barrel 13. Although shown as separate sections, the intermediate body section 12 and the barrel may be combined into a single main body section. Because of the high voltages present in the gun 10, the barrel 13 is formed from an electrically insulating synthetic resinous material. The handle 11 and the intermediate body section 12 are formed from an electrically conductive synthetic resinous material. A fluid supply tube 14 supplies coating material to a passage 15 in the barrel 13. From the passage 15, the fluid flows through a fluid tip 16 and is discharged from an orifice 17. A valve needle 18 controls the flow of fluid through the orifice 17. The valve needle 18 is manually controlled by a trigger 19. An electrode wire 20 attached to an end of the valve needle 18 projects through the orifice 17. A high voltage applied to the electrode wire 20 imparts an electrostatic charge to the fluid as it is atomized.

In addition to the fluid tip 16, an air cap 21 is attached to the barrel 13 by a retainer ring 22 which engages threads 23 on the barrel 13. The air cap 21 and the fluid tip 16 form a nozzle which atomizes the fluid and shapes the pattern of the atomized fluid. Compressed air is supplied from a conventional source (not shown) to a fitting 24 on the gun handle 11. From the fitting 24, the compressed air flows through a tube 25 in the handle, and through a passage 26 (shown only in part) in the intermediate body section 12 and in the barrel 13 to a chamber 27 between the barrel 13, the fluid tip 16, the air cap 21 and the retainer ring 22. At least a portion of the compressed air is discharged through an annular orifice 28 which surrounds the fluid orifice 17 to atomize fluid discharged from the orifice 17. Optionally, a portion of the compressed air may be discharged from one or more orifices 29 for shaping the pattern of the atomized fluid from a round to a flat or fan shaped pattern.

The spray gun 10 has an internal high voltage power supply 30. In the illustrated spray gun 10, the power supply 30 includes an oscillator module 31, a voltage multiplier circuit module 32 and a switching circuit 33. The oscillator module 31 is mounted in the handle, the circuit module 32 is mounted in the intermediate body section 12 and the barrel 13, and the switching circuit 33 is mounted in the intermediate body section 12. A low voltage direct current is applied through a connector 34 on the handle 11 to the oscillator module 31. The oscillator module 31 includes an oscillator which convert the low voltage direct current to alternating current. The alternating current is applied to the circuit module 32 which steps up the alternating current to an intermediate voltage and rectifies and multiplies the intermediate voltage to obtain a high voltage direct current which may be on the order of from 20,000 to 80,000 volts, for example. The high voltage output from the module 32 is applied through a conductor 35 and the valve needle 18 to the electrode wire 20 for charging the atomized fluid. If desired, the valve needle may include a resistor (not shown) connected in series between the module 32 and the electrode wire 20 to limit the energy available at the electrode wire 20 in the event of arcing. The switching circuit 33 includes a switch 36 which is manually operated to turn on and off the high voltage by controlling the circuit module 31. The circuit 33 limits the voltage and the current at the switch 36 to very low levels which will not arc when the switch 36 is operated, since arcing may ignite flammable solvent fumes from the paint spray.

Figure 2:
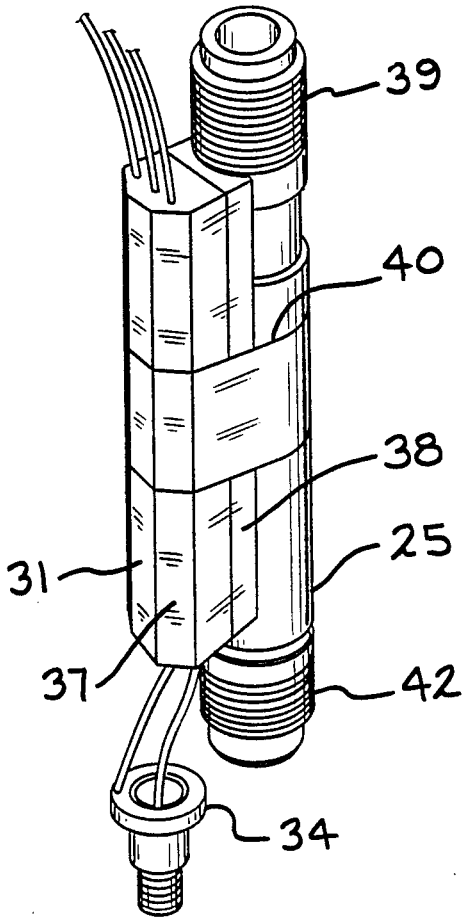
FIG. 2 is a perspective view of the circuit module and attached air supply tube from the handle of the spray gun of FIG. 1 according to the invention.

During operation of the spray gun, heat is produced by the circuit module 31. According to the invention, improved means is provided for removing excessive heat from the spray gun handle 11 for the comfort of the operator and to protect teh circuity in the module 31. Referring now to FIGS. 1 and 2, the circuit module 31 includes a housing 37 which includes at least a relatively thick face or heat sink 38 formed from a material having a high thermal conductivity, such as aluminum. The heat sink 38 is shaped to conform with the exterior of the tube 25 to provide intimate heat transfer contact between one side of the tube 25 and the heat sink 38 along the length of the tube 25. The tube also is formed from a material having a high thermal conductivity, such as aluminum, to provide good heat transfer from the tube to the compressed air flowing through the tube.

In assembling the handle 11 on the spray gun 10, an upper end 39 on the tube 25 is threaded into the passage 26 in the intermediate body section 12. The circuit module 31 then is attached to the tube 25, for example, by tape 40 or by a plastic tie wrap or a metal fastener (not shown). The handle 11 is slipped over the tube 25 and the circuit module 31. A nut 41 attaches the connector 34 to the handle 11 and the fitting 24 is threaded onto a lower end 42 of the tube 25 to retain the handle 11 on the intermediate body section 12.

During operation of the spray gun 10, heat emanating from the circuit module 31 is conducted through the heat sink 38 and the tube 25 to compressed air flowing through the tube 25 to the spray gun nozzle. The Handle 11 may be formed from a synthetic resin having a relatively poor thermal conductivity as compared to the thermal conductivity of the heat sink 38 and the tube 25. As a consequence, the temperature of the handle 11 is maintained at level which is comfortable to the operator and will not damage the circuitry in the module 31.

It will be appreciated that various modifications may be made to the above described preferred embodiment of the invention without departing from the spirit and the scope of the following claims. For example, it will be appreciated that the entire high voltage power supply may be located in the spray gun handle, as distinguished from one of several modules forming the power supply. Although tape is suitable for attaching the module 31 to the tube 25, other known types of fasteners may be used. Also, the invention is applicable to other designs and types of spray guns having heat generating circuitry in the gun.

I claim:

1. A hand held electrostatic spray gun comprising a gun body and a nozzle assembly attached to said body, means for supply liquid to said nozzle assembly for atomization, means for supplying compressed air through said body to said nozzle assembly, said compressed air supplying means including a heat conducting tube located in said body, wherein the compressed air supplied through said body to said nozzle flows through said tube, high voltage power supply means located in said body for generating an electrostatic voltage which imparts a charge to the atomized liquid, said power supply means including a circuit module which produces heat during operating, means for transferring heat from said circuit module to the compressed air flowing through said body to said nozzle, and wherein said heat transferring means includes said heat conducting tube and a heat sink mounting said circuit module on said heat conducting tube.

2. A hand held electrostatic spray gun comprising a gun body and a nozzle assembly attached to said body, means for supplying liquid to said nozzle assembly for atomization, means for supplying compressed air through said body to said nozzle assembly, said compressed air supplying means including a heat conducting tube located in said body, wherein the compressed air supplied through said body to said nozzle flows through said tube, high voltage power supply means located in said body for generating an electrostatic voltage which imparts a charge to the atomized liquid, said power supply means including a circuit module which produces heat during operating, means for transferring heat from said circuit module to the compressed air flowing through said body to said nozzle, and wherein said heat transferring means includes said heat conducting tube and a heat sink mounting said circuit module on said heat conducting tube, wherein said body includes a handle and an intermediate body section, wherein said tube is located in said handle and attached to said intermediate body section, and wherein said means mounting said circuit module on said tube comprises tape.

3. A hand held electrostatic spray gun, as set forth in claim 2, wherein said circuit module includes a heat sink having a surface shaped to contact and transfer heat from said circuit module to said tube.

4. A hand held electrostatic spray gun, as set forth in claim 2, wherein said handle is made from an electrically conductive thermally insulating synthetic resinous material.

5. A hand held spray gun comprising a gun body including a handle and a main body section, a nozzle assembly, means attaching said nozzle assembly to said main body section, means for supplying liquid to said nozzle assembly for atomization, means for supplying compressed air through said body to said nozzle assembly, an electric circuit module which produces heat during operation of said spray gun, a thermally conducting tube attached to said main body section, said compressed air flowing through said tube to said nozzle, and means attaching said circuit module to said tube for conductive heat transfer from said circuit module to compressed air flowing through said tube.

6. A hand held spray gun comprising a gun body, as set forth in claim 5, wherein said means attaching said circuit module to said tube includes a heat sink providing intimate thermal contact between said circuit module and said tube along a substantial length of said tube.

7. A hand held spray gun comprising a gun body including a handle and a main body section, a nozzle assembly, means attaching said nozzle assembly to said main body section, means for supply liquid to said nozzle assembly for atomization, means for supplying compressed air through said body to said nozzle assembly, an electric circuit module which produces heat during operation of said spray gun, a thermally conducting tube attached to said main body section, said compressed air flowing through said tube to said nozzle, and means attaching said circuit module to said tube for conductive heat transfer from said circuit module to compressed air flowing through said tube including a heat sink providing intimate thermal contact between said circuit module and said tube along a substantial length of said tube, and tape binding together said circuit module, said heat sink and said tube.

8. A hand held spray gun comprising a gun body, as set forth in claim 6, wherein said handle is hollow, said handle extending over said tube, said heat sink and said circuit module, said tube having a threaded end extending from said handle, and an air fitting attached to said threaded tube end for retaining said handle on said main body section.

9. A hand held spray gun comprising a gun body, as set forth in claim 8, wherein said handle is made from an electrically conductive thermally insulating synthetic resinous material.

* * * * *